US005464209A

United States Patent [19]

Sang

[11] Patent Number: 5,464,209

[45] Date of Patent: Nov. 7, 1995

[54] PORTABLE FOOTBALL HOLDER

[76] Inventor: Rick Sang, 1764 Plano Rd., Bowling Green, Ky. 42104

[21] Appl. No.: 121,646

[22] Filed: Sep. 16, 1993

[51] Int. Cl.[6] ..... A63B 67/00

[52] U.S. Cl. ..... 273/55 B

[58] Field of Search ..... 273/55 B, 55 R

[56] References Cited

U.S. PATENT DOCUMENTS

| | | | |
|---|---|---|---|
| 3,462,145 | 8/1969 | Shirley et al. | 273/55 B |
| 3,897,948 | 8/1975 | Gerela | 273/55 B |
| 4,546,974 | 10/1985 | Brown | 273/55 B |
| 4,632,395 | 12/1986 | Ferrebee | 273/55 B |
| 4,634,122 | 1/1987 | Kline | 273/55 B |
| 4,946,165 | 8/1990 | Rambacher | 273/55 B |
| 5,009,414 | 4/1991 | Bass | 273/55 R |

*Primary Examiner*—Theatrice Brown
*Attorney, Agent, or Firm*—H. Jay Spiegel

[57] ABSTRACT

A portable football holder includes two mutually pivotable legs with one leg having an end designed to engage the tip of a football to hold the football in an upright position, and with the other leg being connected to a V-shaped base. The V-shaped base is designed to sit on a ground surface to support the portable football holder. In the preferred embodiment of the present invention, the component parts of the legs are made of plastic pipe and plastic couplings.

9 Claims, 3 Drawing Sheets

PORTABLE FOOTBALL HOLDER

BACKGROUND OF THE INVENTION

The present invention relates to a portable football holder. In the prior art, portable football holders are generally known. However, Applicant is unaware of any such portable football holder including all of the features and aspects of the present invention.

The following prior art is known to Applicant:

U.S. Pat. No. D235,462 to Pennington discloses a football kicking tee including a base having projections designed to embed in a ground surface and a ball holder including an arm designed to engage the tip of a football. The present invention differs from the teachings of Pennington as contemplating a portable football holder having two mutually pivotable legs with one leg attached to a base which merely sits on a ground surface rather than being embedded therein.

U.S. Pat. No. 3,462,145 to Shirley et al. discloses a football kicking tee including a base having pointed projections designed to be embedded in a ground surface and a spring biased pivotable arm having an end designed to engage the tip of a football. The present invention differs from the teachings of Shirley et al. as contemplating a portable football holder having two mutually pivotable legs with one leg attached to a base which merely sits on a ground surface rather than being embedded therein.

U.S. Pat. No. 3,897,948 to Gerela discloses a football place-kicking device including a base designed to sit on a ground surface and an angled upright having a flexible arm extending therefrom. The present invention differs from the teachings of Gerela as contemplating a portable football holder having two mutually pivotable legs with one leg attached to a base which sits on a ground surface.

U.S. Pat. No. 4,049,267 to Forrest discloses a football place-kicking device including a U-shaped member having one end designed to be attached to a conventional kicking block and another end having a flexible end designed to engage the tip of a football to hold the football on the kicking block. The present invention differs from the teachings of Forrest as contemplating a portable football holder having two mutually pivotable legs with one leg attached to a base which sits on a ground surface.

U.S. Pat. No. 4,477,077 to Ferrebee discloses a football place/field goal kicking device including a base supporting an upright and three mutually pivotable legs with a distal leg having an end designed to engage the tip of a football from directly above to support the football on a ground surface. The present invention differs from the teachings of Ferrebee as contemplating two mutually pivotable legs with one leg being directly connected to a base and with the other leg designed to engage the tip of a football from the side. U.S. Pat. No. 4,632,395 also to Ferrebee discloses a similar device with the difference being an additional pivot on the upright. The present invention differs from the teachings of this Ferrebee patent for the same reasons set forth above concerning U.S. Pat. No. 4,477,077 to Ferrebee.

U.S. Pat. No. 4,546,974 to Brown discloses a football holding device including a base and a spring-biased arm extending therefrom and designed to engage the tip of a football from the side. The present invention differs from the teachings of Brown as contemplating a portable football holder having two mutually pivotable legs with one leg attached to a base which sits on a ground surface.

U.S. Pat. No. 4,634,122 to Kline discloses a holder for football place-kicking practice which includes a base designed to support a kicking block and also having mounted thereto a double arm to which is pivoted a horizontally extending arm designed to engage the tip of a football from the side. The horizontally extending arm also includes a tension adjustment device consisting of a weight, the position of which may be adjusted along the arm. The present invention differs from the teachings of Kline as contemplating a base connected with one of the arms, which base pivots upwardly away from the ground surface in the ball supporting position.

U.S. Pat. No. 4,807,880 to Deal discloses a ball support device including an inverted J-shaped support arm designed to engage the tip of a football from above. The present invention differs from the teachings of Deal as contemplating a portable football holder having two mutually pivotable legs with one leg attached to a base which sits on a ground surface.

U.S. Pat. No. 4,946,165 to Rambacher discloses a football holder for place-kicking which includes a base having a fixed upright and a horizontally pivotable arm extending therefrom and designed to engage the tip of a football from the side. The present invention differs from the teachings of Rambacher as contemplating two mutually pivotable legs with one of the legs engaging the tip of a football from the side and with the other leg being connected with a V-shaped base which pivots away from the ground in the position wherein the tip of the football is engaged.

SUMMARY OF THE INVENTION

The present invention relates to a portable football holder. In this application and in the claims, the term "football" is meant to refer to an American-style football also known as an oblate spheroid. The present invention includes the following interrelated objects, aspects and features:

(A) In a first aspect, the inventive portable football holder includes base means comprising a base which is of generally V-shaped configuration having two arms defining an obtuse angle therebetween defined at an apex. One of the arms has a tubular fitting extending therefrom generally perpendicular to a plane which mutually includes the two arms.

(B) The fitting allows removable attachment of a ball holding member which consists of two mutually pivotable legs. The proximal leg is releasably coupled to the tubular fitting. The distal leg has a gum rubber tubing covering thereover at its distal end which is designed to engage the tip of a football to lightly hold the football on a ground surface whether artificial turf or grass or when using a kicking block (tee).

(C) The two legs are mutually pivoted through the use of a pivotable coupling consisting of two right angle elbows mounted together and held in place by a flexible sleeve mounted thereover. The proximal leg may also include a tubular fitting extending at a right angle thereto and designed to couple with the tubular fitting of the base to allow the base to be mounted thereon for easy transport and storage.

(D) In use, the legs are mutually pivoted to a degree permitting support of a football with the distal end of the distal leg engaging the football tip to support the football in a vertical configuration. When the legs are mutually pivoted to the desired degree, the football is supported by the tendency of the entire device to pivot toward the ground surface about the base under force of gravity. This tendency causes a sufficient force in a downward direction over the tip of the football to support the football in a manner simulating a human holder. This above-described configuration necessitates pivoting of the base so that the apex thereof is off the ground and the base is merely supported on the ends of the arms thereof distal from the apex.

As such, it is a first object of the present invention to provide a portable football holder.

It is a further object of the present invention to provide such a portable football holder including a V-shaped base and two mutually pivotable legs attached thereto.

It is a still further object of the present invention to provide such a device including a distal leg having its distal end covered with gum rubber tubing.

It is a still further object of the present invention to provide a proximal leg thereof with a tubular fitting permitting attachment of the base for storage and transport.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
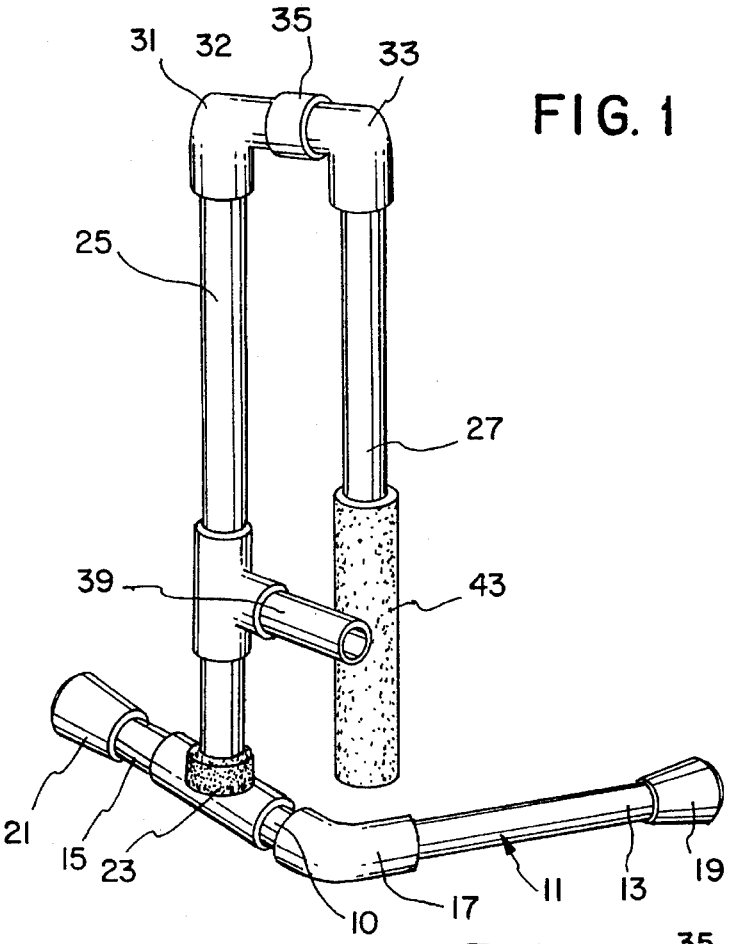
FIG. 1 shows a perspective view of the inventive portable football holder in a first position.

With reference, first, to FIG. 1, the present invention is generally designated by the reference numeral 10 and is seen to include a base 11 of V-shaped configuration including arms 13 and 15 connected together at an apex 17, with the arms 13 and 15 defining an obtuse angle therebetween.

As shown in the figures, the ends of the arms 13 and 15 distal from the apex 17 have resilient covers 19 and 21, respectively, for a purpose to be described in greater detail hereinafter.

As also shown in the figures, the arm 15 has a fitting 23 which extends perpendicularly to a plane which encompasses the axes of elongation of the arms 13 and 15. The fitting 23 is sized to receive the proximal end of a proximal leg 25 to which is pivotably connected a distal leg 27. The coupling between the legs 25 and 27 is generally designated by the reference numeral 30 and includes an elbow 31 attached to the proximal leg 25 and an elbow 33 attached to the proximal end of the distal leg 27. The elbow 33 has an angled end proximal of the distal leg 27 having an outer surface slidably received within the inner surface of a distal end of the elbow 31. As coupled together, gum rubber tubing 35 is stretched over the coupling 30 and provides friction allowing the legs 25 and 27 to be maintained in any one of an infinite number of angular relationship defined by mutually pivoted positions with respect to one another and defining diverse angles therebetween. While the specific structure of the interengagement of the proximal end of the elbow 33 with the distal end of the elbow 31 is not particularly illustrated, based upon the above description, this configuration should be self-evident. In a further aspect thereof, the interengaging portions of the elbows 31 and 33 have circular cross-sections allowing free rotation therebetween only impeded by the frictional forces imposed by the resilient gum rubber tubing 35.

Figure 6:
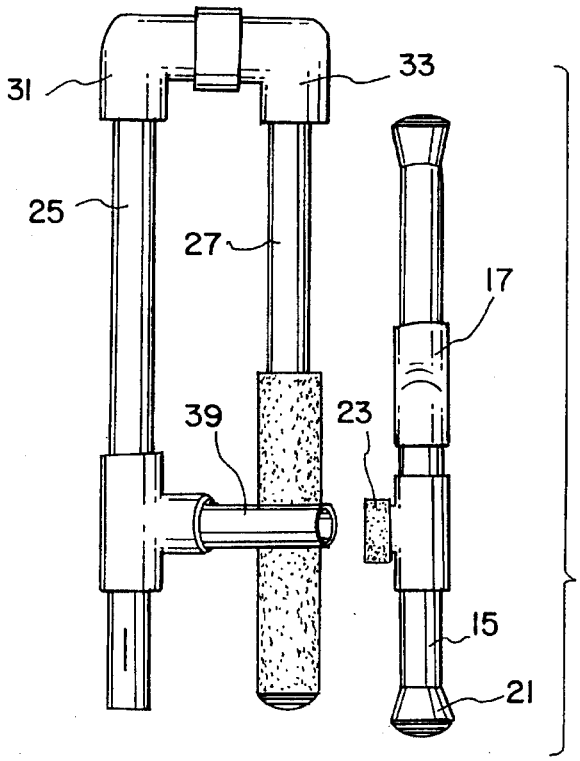
FIG. 6 shows the present invention with the base thereof removed from one fitting and about to be placed on another fitting for easy transport.

As shown in the figures, the proximal leg 25 includes a tubular fitting 39 which is of the same outer diameter as the proximal end of the proximal leg 25. As particularly shown in FIG. 6, the fitting 39 may receive the fitting 23 of the base 11 to best facilitate easy storage and transport of the device 10.

As also shown in the figures, the distal end of the distal leg 27 is covered with an elongated gum rubber tubing 43 which is resilient and permits engagement with the tip of a football with a "light" touch, simulating a human holder.

Figure 2:
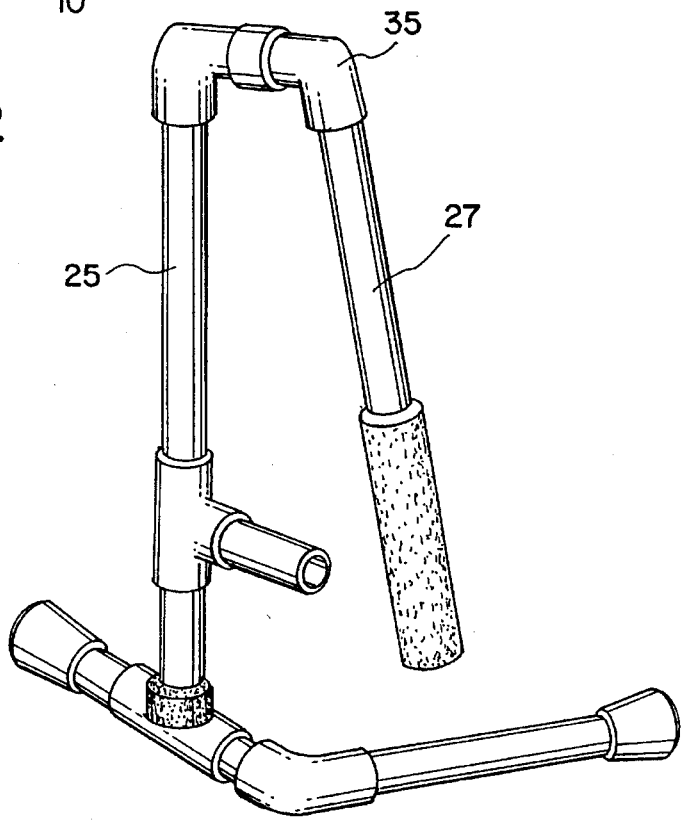
FIG. 2 shows a perspective view of the inventive portable football holder in a second position.
Figure 3:
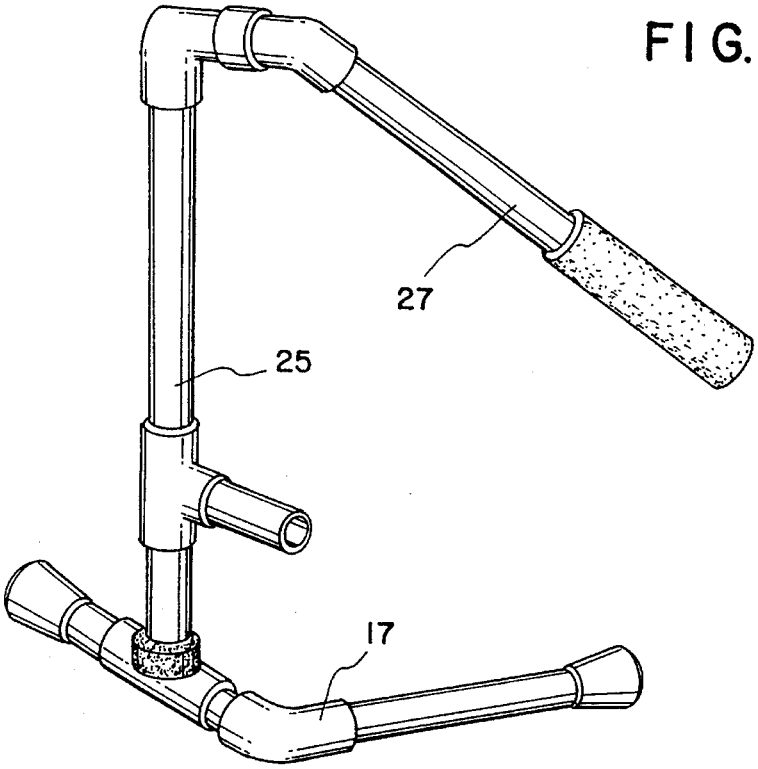
FIG. 3 shows a perspective view of the inventive portable football holder in a third position.

With the present invention having been described in great detail, the particular preferred mode of operation will now be described. As shown in FIG. 1, a football 1 is lying on the ground. The inventive device 10 is held in an upright position on the ground surface with the legs 25 and 27 mutually pivoted to a position wherein the leg 27 engages the tubular fitting 39. As shown when following FIGS. 2, 3 and 4 in sequence, the legs 25 and 27 are mutually pivoted against the frictional forces imposed by the sleeve 35 until the leg 27 is extended to a degree causing the base 11 to pivot such that the apex 17 thereof is off the ground and the base 11 is supported on the ground surface solely by the tips 19 and 21 of the respective arms 13 and 15 thereof. This is best seen with reference to FIGS. 4 and 5.

Figure 4:
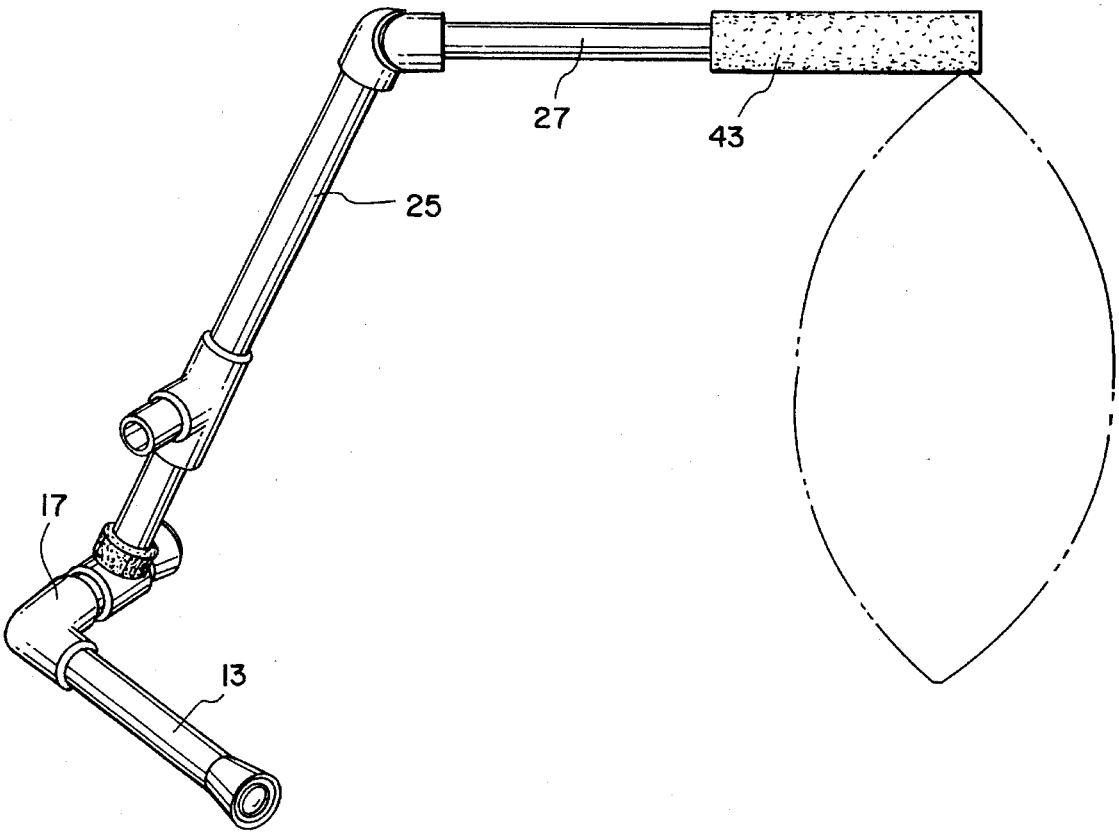
FIG. 4 shows a perspective view of the inventive portable football holder in a fourth position supporting a football in an upright position.
Figure 5:
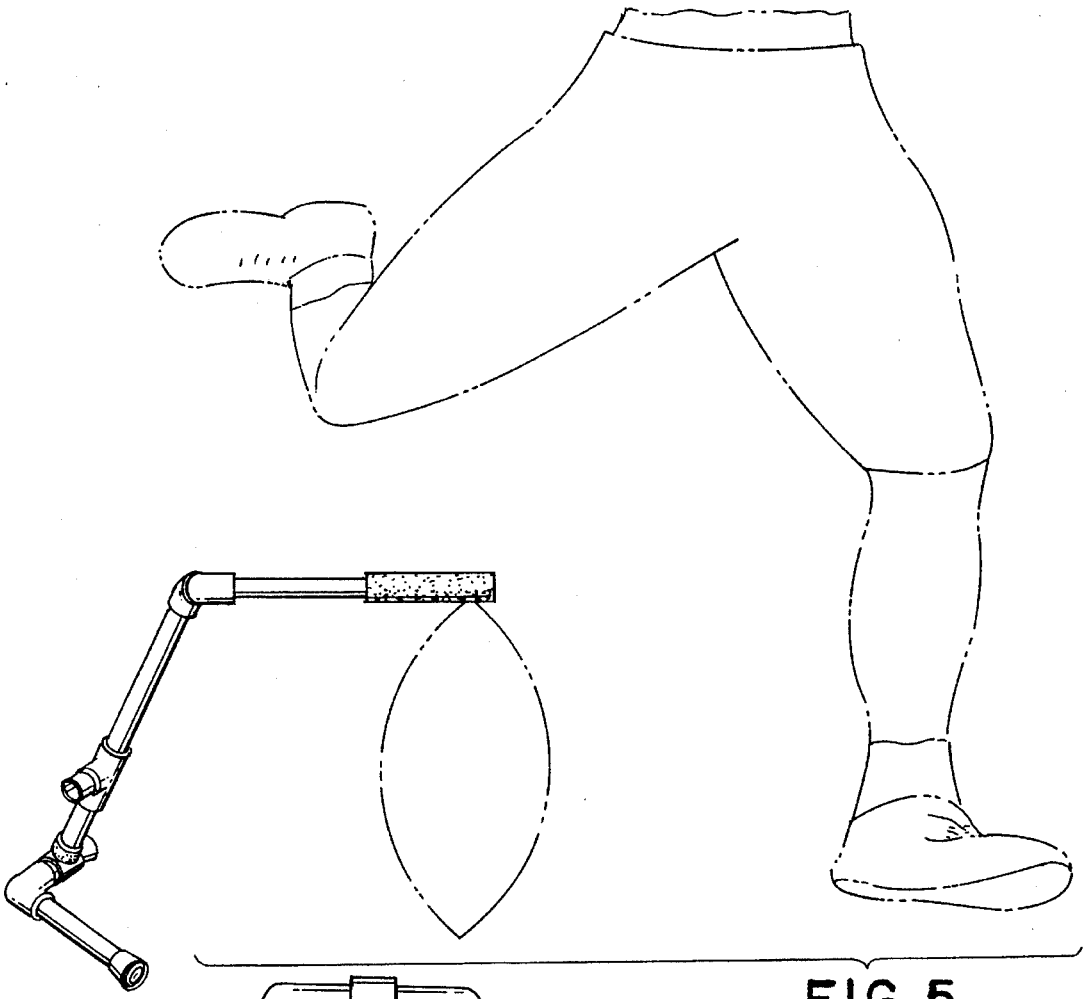
FIG. 5 shows a front view of the present invention supporting a football which is about to be kicked.

In the position of the inventive device 10 best seen in FIGS. 4 and 5, the base 11 maintains the position shown with the apex 17 off the ground because gravitational forces tend to pivot the entire device as a unit in a clockwise direction in the view of FIGS. 4 and 5 thereby causing the distal end of the distal leg 27 to impose a slight downward force on the tip of the football 1 in the position shown in FIGS. 4 and 5.

Under such circumstances, the gum rubber tubing 43 engages the tip of the football 1 with a light touch, since the entire device 10 is preferably made of lightweight materials, so that the downward force imposed on the tip of the football 1 closely simulates the force which would be placed on the tip of the football 1 by the finger of a human holder. The design of the holder encourages the user to position the ball in an upright (vertical) position which increases the impact surface area thus enabling maximum height and distance when the ball is kicked.

As explained above, the frictional forces placed on the coupling 30 by the resilient sleeve 35 maintain the orientation of the legs 25 and 27 with respect to one another in whatever position is imposed upon them by the user. As particularly shown in FIG. 5, a football may be securely held in an upright position for kicking by a place-kicker with the legs 25 and 27 being maintained in their set position, with the apex 17 of the base 11 suspended off the ground and with the tip of the football being lightly engaged by the gum rubber tubing 43.

In the preferred embodiment of the present invention, the base 11 and legs 25 and 27 are made of molded plastic pipes while the sleeves 23, 35 and 43 are made of gum rubber tubing and the tips 19 and 21 and the inserted tip on the end of tubing 43 are made of rubber.

As such, an invention has been disclosed in terms of a preferred embodiment thereof which fulfills each and every one of the objects of the invention as set forth hereinabove and provides a new and useful portable football holder of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. A portable football holder for supporting a football having a football tip in an upright position, comprising:

a) base means for supporting said holder on a ground surface;

b) a proximal leg fixedly attached to said base means and extending therefrom;

c) a distal leg pivotably attached to said proximal leg by coupling means for permitting fixation of an angular relationship between said proximal leg and distal leg at any one of a multiplicity of diverse angles, said distal leg having a distal end with a football tip engaging-portion thereon;

d) said legs being pivotable to and fixable at an orientation whereby with said football tip placed beneath said distal end of said distal leg with said football in said upright position and said distal leg extending generally horizontally with respect to said ground surface, force of gravity pivots said holder, as a unit, in a direction forcing said distal end of said distal leg toward said ground surface with a downward force with said base means pivoted with respect to said ground surface, said downward force causing said distal end to engage said football tip and hold said football in said upright position.

2. The holder of claim 1, wherein said base means comprises a V-shaped base consisting of first and second arms joined at an apex.

3. The holder of claim 2, wherein said arms define an obtuse angle therebetween.

4. The holder of claim 2, wherein said proximal leg is attached to said first arm, said apex being suspended off said ground surface when said distal end of said distal leg engages said football tip to hold said football in said upright position.

5. The holder of claim 1, wherein said distal end of said distal leg is covered with gum rubber tubing.

6. The holder of claim 1, said coupling including an elbow on a distal end of said proximal leg coupled to an elbow on a proximal end of said distal leg.

7. The holder of claim 6, further including a resilient sleeve covering said coupling and engaging outer surfaces thereof whereby said legs may be pivoted with respect to one another by providing a pivoting force overcoming frictional forces caused by engagement of said sleeve on said outer surfaces of said coupling, said legs being retained in any one of an infinite number of pivotable orientations with respect to one another.

8. The holder of claim 1, wherein said base means and legs are made of plastic.

9. The holder of claim 1, wherein said proximal leg has a first tubular fitting extending therefrom at a proximal end thereof for attachment to said base means, said proximal leg having a second tubular fitting between said proximal end and a distal end thereof, said base means being removable from said first tubular fitting and being attachable to said second tubular fitting for storage and transport of said holder.

* * * * *